US008362851B2

(12) United States Patent
Tsai et al.

(10) Patent No.: US 8,362,851 B2
(45) Date of Patent: Jan. 29, 2013

(54) HIGH ISOLATION POWER DIVIDER

(75) Inventors: Wen-Tsai Tsai, Taipei-Hsien (TW); Che-Ming Wang, Taipei-Hsien (TW)

(73) Assignee: Wistron NeWeb Corporation, Hsi-Chih, Taipei Hsien (TW)

( * ) Notice: Subject to any disclaimer, the term of this patent is extended or adjusted under 35 U.S.C. 154(b) by 284 days.

(21) Appl. No.: 12/775,490

(22) Filed: May 7, 2010

(65) Prior Publication Data

US 2010/0321131 A1 Dec. 23, 2010

(30) Foreign Application Priority Data

Jun. 22, 2009 (TW) ..... 98120836 A

(51) Int. Cl.
*H01P 5/12* (2006.01)

(52) U.S. Cl. ..... 333/128; 333/132; 333/136

(58) Field of Classification Search ..... 333/124–129, 333/132, 134–137
See application file for complete search history.

(56) References Cited

U.S. PATENT DOCUMENTS 3,815,055 A * 6/1974 Plunk et al. ..... 333/128
7,164,903 B1 * 1/2007 Cliff et al. ..... 455/327

* cited by examiner

*Primary Examiner* — Robert Pascal
*Assistant Examiner* — Kimberly Glenn
(74) *Attorney, Agent, or Firm* — Winston Hsu; Scott Margo

(57) ABSTRACT

A high isolation power divider is disclosed, which includes a substrate, a first split arm, a second split arm, a signal input unit, a connection unit, a ground layer, a slit. The signal input unit is coupled to the first split arm and the second split arm for receiving an input signal and dividing the input signal to the first split arm and second split arm. The connection unit is coupled to the first split arm and the second split arm, wherein the connection unit, the first split arm, and the second split arm are deposited on a first plane of the substrate, and surround a first area. The ground layer is deposited on the second plane of the substrate for providing grounding. The slit is formed in the ground layer, wherein at least a part of the slit is formed within a second area corresponding to the first area.

13 Claims, 11 Drawing Sheets

HIGH ISOLATION POWER DIVIDER

BACKGROUND OF THE INVENTION

1. Field of the Invention

The present invention relates to a power divider, and more particularly, to a power divider capable of providing high isolation characteristic without using resistors.

2. Description of the Prior Art

Power dividers are wide used in microwave circuits for splitting an input signal into two or more in-phase signals. For example, a Wilkinson power divider or a T-junction power divider are the most commonly used power dividers. In general, the Wilkinson power divider needs an extra resistor for enhancing isolation characteristics. The T-junction power divider does not require using an extra resistor, but has bad isolation characteristics.

Please refer to FIG. 1. FIG. 1 is a schematic diagram of a Wilkinson power divider 10 in the prior art. The Wilkinson power divider 10 includes an input port 102, split ports 104, 106, and a resistor 108. The resistance of the resistor 108 is usually twice the impedance of the input port 102. For example, an impedance of the input port 102 is Zo, impedances of the split ports 104, 106 are $\sqrt{2}$ Zo, and an impedance of the resistor 108 is equal to 2 Zo. In the Wilkinson power divider 10, when an input signal SI enters the input port 102, the input signal SI can be split into equal-phase output signals SO1, SO2 to the split ports 104, 106, and be transmitted to the output ports 110, 112, respectively. However, a resistor element usually has its operating frequency limit, so that when the Wilkinson power divider 10 using a resistor operates at high frequency, parasitic capacitance and inductance effects will occur inducing bad electric characteristics. Please refer to FIG. 2. FIG. 2 is a simulation result of the Wilkinson power divider 10 using an ideal resistor at high frequency, which the input port 102 and the output ports 110, 112 are served as the first port, the second port, and the third port, respectively. Also, the resistor 108 is implemented with a 100 ohm ideal resistor. As can be seen in FIG. 2, though the Wilkinson power divider 10 utilizes the ideal resistor (parasitic inductance effect is removed), the isolation parameter S23 is still poor, only about −8 dB. Thus, even when the resistor 108 is replaced by an ideal resistor, the Wilkinson power divider 10 can also not provide sufficient isolation, and this shows the Wilkinson power divider 10 is really not able to apply to high frequency band.

In addition, as the Wilkinson power divider 10 is operated at high frequency band, the size of the quarter wavelength split ports 104, 106 may become too small. Taking an RO4233 substrate (dielectric coefficient is 3.33) for example, the length of the split ports 104, 106 remains at only 2.4 mm when operating at Ka band. As a result, owing to the short distance between the split ports 104, 106, a large coupling effect will occur. In such a condition, the Wilkinson power divider 10 using an ideal resistor can still not provide enough isolation characteristics.

In short, the T-junction does not need an extra resistor, but can not provide sufficient isolation. Although the conventional Wilkinson power divider can achieve a certain isolation characteristic when operating at low frequency band, enough isolation is not provided when operating at high frequency band.

SUMMARY OF THE INVENTION

It is therefore a primary objective of the claimed invention to provide a high isolation power divider.

An embodiment of the invention discloses a high isolation power divider, which includes a substrate comprising a first plane and a second plane; a first split arm deposited on the first plane of the substrate, wherein the first split arm comprises a first end and a second end; a second split arm deposited on the first plane of the substrate, wherein the second split arm comprises a first end and a second end; a signal input unit deposited on the first plane of the substrate, and coupled to the first end of the first split arm and the first end of the second split arm, for receiving an input signal and dividing the input signal to the first split arm and the second split arm; a connection unit deposited on the first plane of the substrate, and coupled to the second end of the first split arm and the second end of the second split arm, wherein the connection unit, the first split arm, and the second split arm surround a first area; a ground layer deposited on the second plane of the substrate for providing grounding; and a slit formed in the ground layer; wherein at least a part of the slit is formed within the second area corresponding to the first area.

These and other objectives of the present invention will no doubt become obvious to those of ordinary skill in the art after reading the following detailed description of the preferred embodiment that is illustrated in the various figures and drawings.

DETAILED DESCRIPTION

Figure 3:
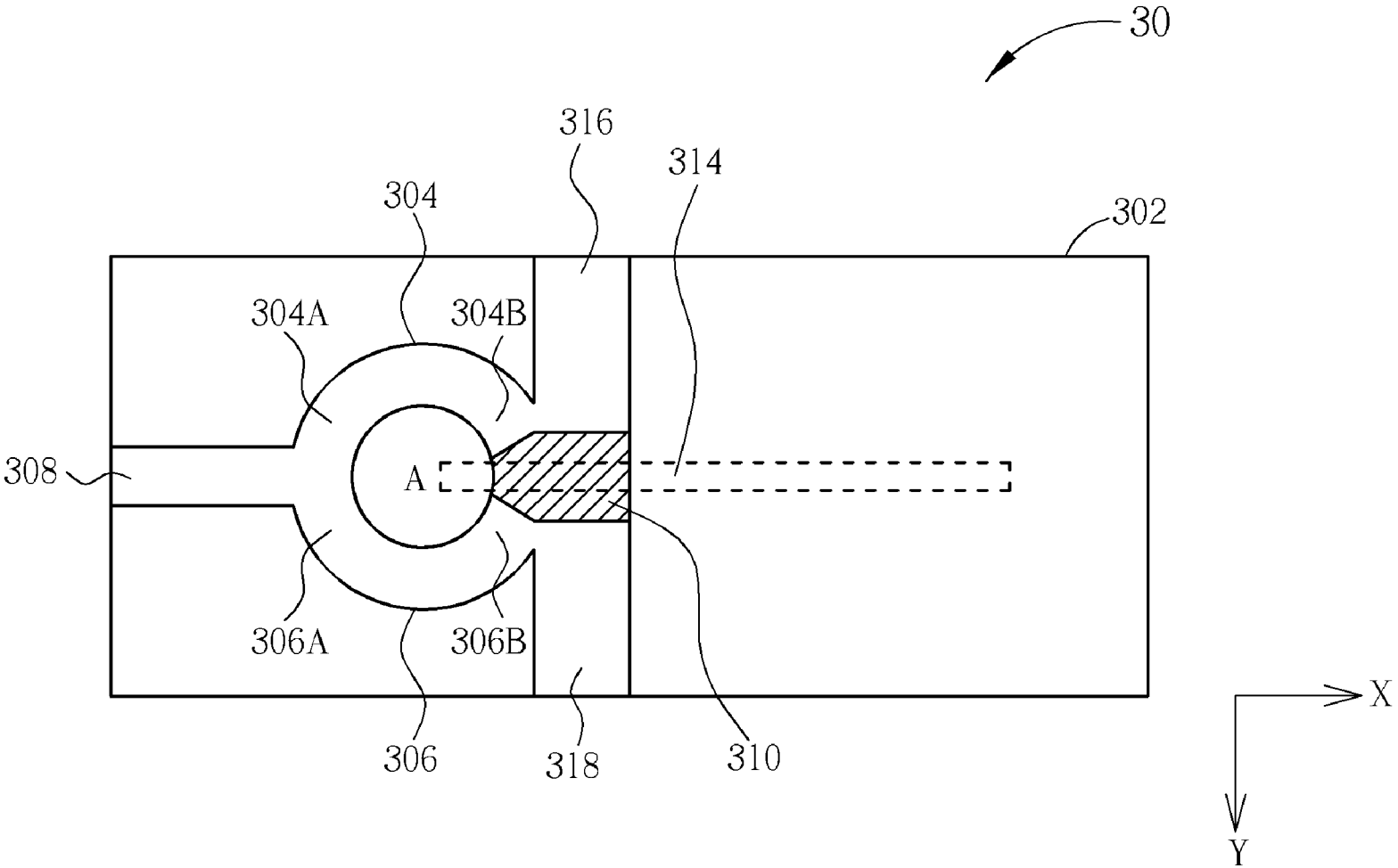
FIG. 3 is a top-view diagram of a power divider according to an embodiment of the invention.
Figure 4:
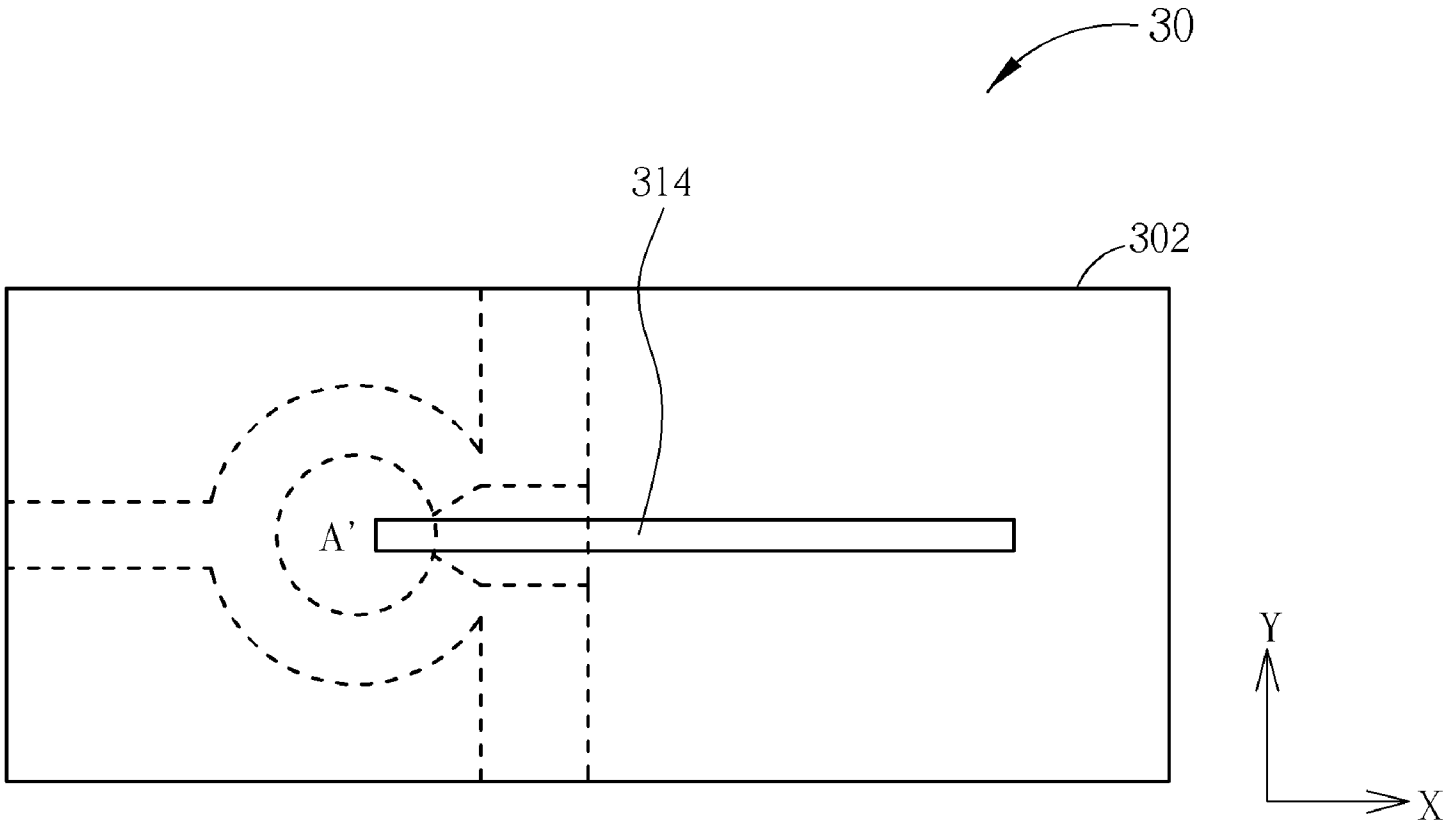
FIG. 4 is a bottom-view diagram of the power divider according to an embodiment of the invention.
Figure 5:
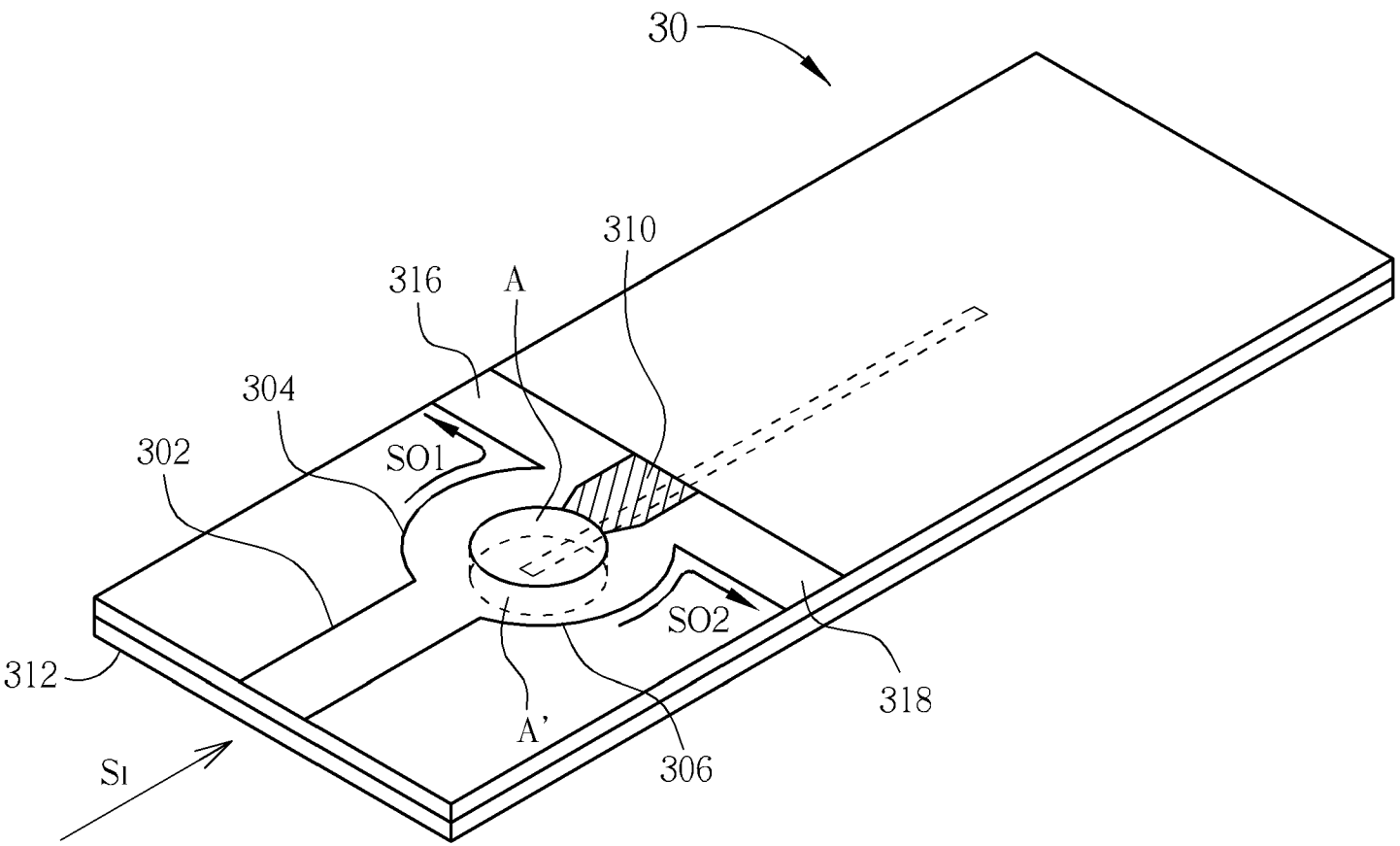
FIG. 5 is a three-dimensional diagram of the power divider according to an embodiment of the invention.

Please refer to FIGS. 3 to 5. FIG. 3 is a top-view diagram of a power divider 30 according to an embodiment of the invention. FIG. 4 is a bottom-view diagram of the power divider 30 according to an embodiment of the invention. FIG. 5 is a three-dimensional diagram of the power divider 30 according to an embodiment of the invention. The power divider 30 includes a substrate 302, a first split arm 304, a second split arm 306, a signal input unit 308, a connection unit 310, a ground layer 312, a slit 314, a first signal output unit 316, and a second signal output unit 318. The substrate 302 includes an upper plane and a bottom plane corresponding to the upper plane. As shown in FIGS. 3 to 5, the first split arm 304, the second split arm 306, the signal input unit 308, the connection unit 310, the first signal output unit 316, and the second signal output unit 318 are deposited on the upper plane of the substrate 302, and both of the ground layer 312 and the slit 314 are deposited on the bottom plane of the substrate 302. Preferably, the first split arm 304, the second split arm 306, the signal input unit 308, and the connection unit 310 can be formed with microstrip line structures. Moreover, a first end 304A of the first split arm 304 and a first end 306A of the second split arm 306 are coupled to the signal input unit 308. In such a condition, the signal input unit 308 can split an input signal SI into output signals SO1, SO2 to the first split arm 304 and the second split arm 306, and the output signals SO1,SO2 will be outputted from the corresponding first signal output unit 316 and second signal output unit 318, respectively. The connection unit 310 is coupled to a second end 304B of the first split arm 304 and the second end 306B of the second split arm 306. The ground layer 312 is utilized for providing grounding. Note that, a first area A on the upper plane of the substrate 302 is encircled by the connection unit 310, the first split arm 304, and the second split arm 306. Also, a second area A' corresponding to the first area A is in the ground layer 312. In other words, the second area A' means a region that the first area A orthographic projects onto the ground layer 312. Therefore, the slit 314 can be formed in the ground layer 312, and at least a part of the slit 314 can be formed within a second area A'.

Compared with the conventional Wilkinson power divider using a resistor element for improving isolation among each of the split ports, the power divider 30 of the invention utilizes the connection unit 310 to substitute for the resistor element, and further forms the slit 314 to generate proper impedance. For the microstrip line theory, the microstrip line can be equivalent to an RLGC circuit model which is composed of a serially connected inductor and resistor, and a parallel connected capacitor and conductance element existing between the microstrip line and ground. The inductance varies with length of the microstrip line and the capacitance is generated through the microstrip line and ground layer 312. As a result, because the power divider 30 has the slit 314 (there is a variation at the grounding portion), the capacitance of the RLGC equivalent circuit will be reduced. Furthermore, characteristic impedance of an ideal and lossless microstrip line is $\sqrt{L/C}$, so that when the capacitance value is reducing, the overall characteristic impedance value increases. Thus, the invention can realize the function of the resistor in the conventional Wilkinson power divider through the design of the slit 314.

In short, the invention can achieve high isolation through the slit 314, and more importantly, the invention can divide an input RF signal into two or more isolated and in-phase signals.

Figure 6:
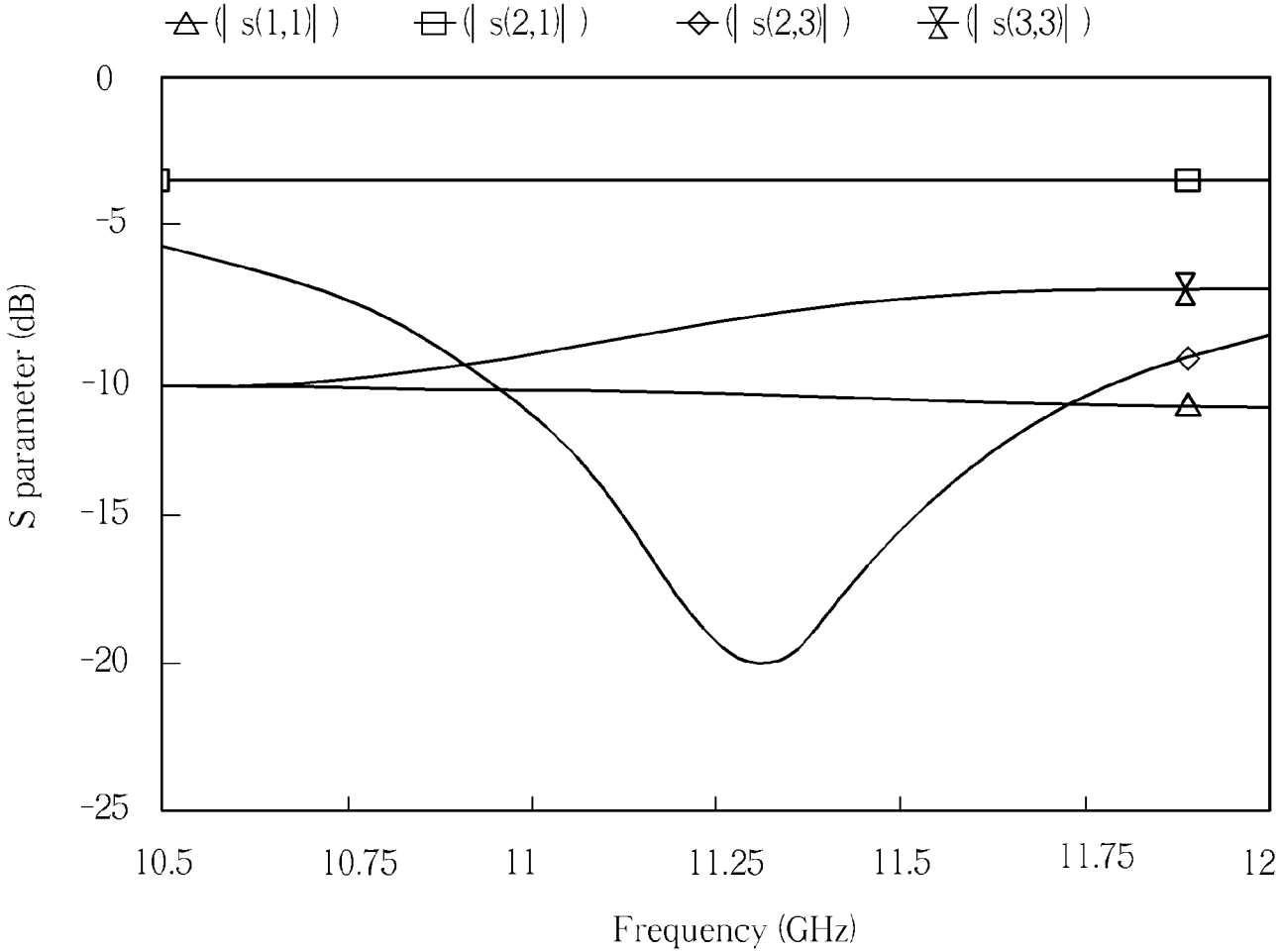
FIG. 6 is a simulation result of the power divider having a rectangular-shaped slit according to an embodiment of the invention.

In the following description, all the simulation results are based on the power divider 30 for clarity. The signal input unit 308 is set to be the first port. The first signal output unit 316 is set to be the second port, and the second signal output unit 318 is set to be the third port. Therefore, s parameters are evaluated accordingly. FIG. 6 is a simulation result of the power divider 30 having a rectangular-shaped slit according to an embodiment of the invention, which is operated at 10.7 to 12.75 GHz band (Ku band), based on the power divider 30 shown in FIG. 5. As shown in FIG. 6, the bandwidth which the isolation parameter S23 is below −15 dB (isolation criterion) is about 0.39 GHz, meaning there is high isolation between the second port and the third port. The reflection parameter S11 is approximately below −10 dB, indicating the energy is almost transmitted.

Figure 7:
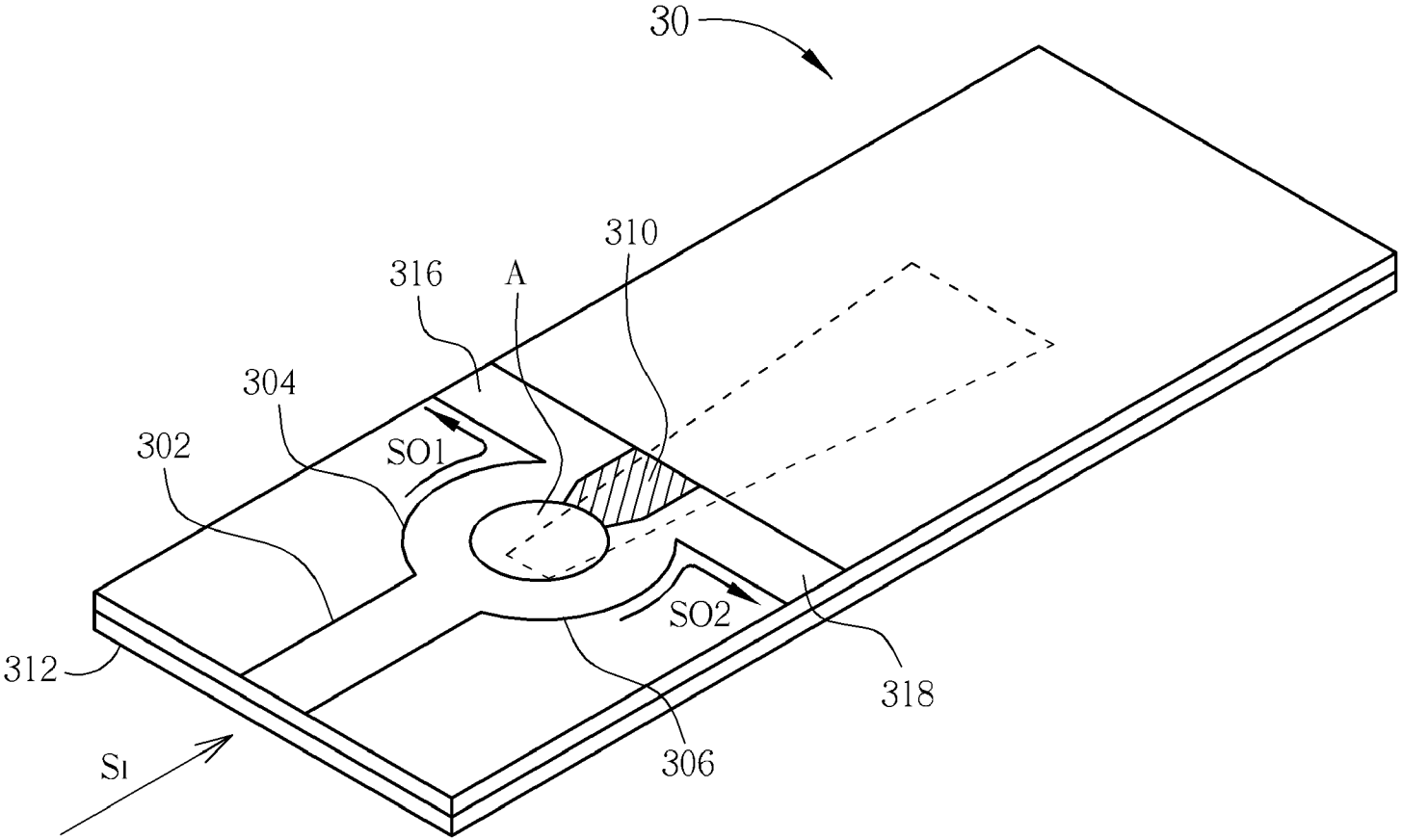
FIG. 7 is a three-dimensional diagram of the power divider according to an embodiment of the invention.
Figure 8:
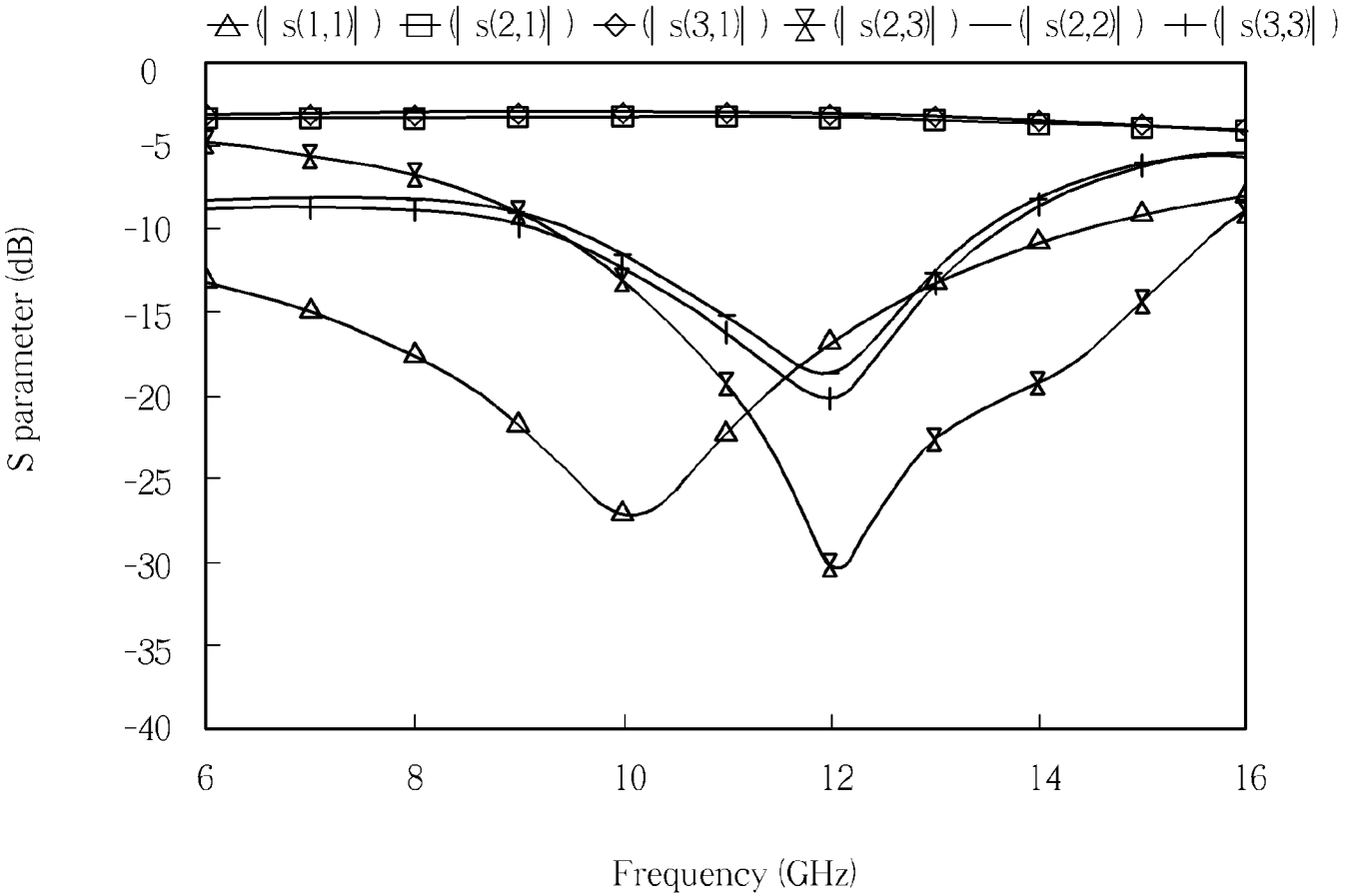
FIG. 8 is a simulation result of the power divider having a trapezoidal-shaped slit according to an embodiment of the invention.
Figure 9:
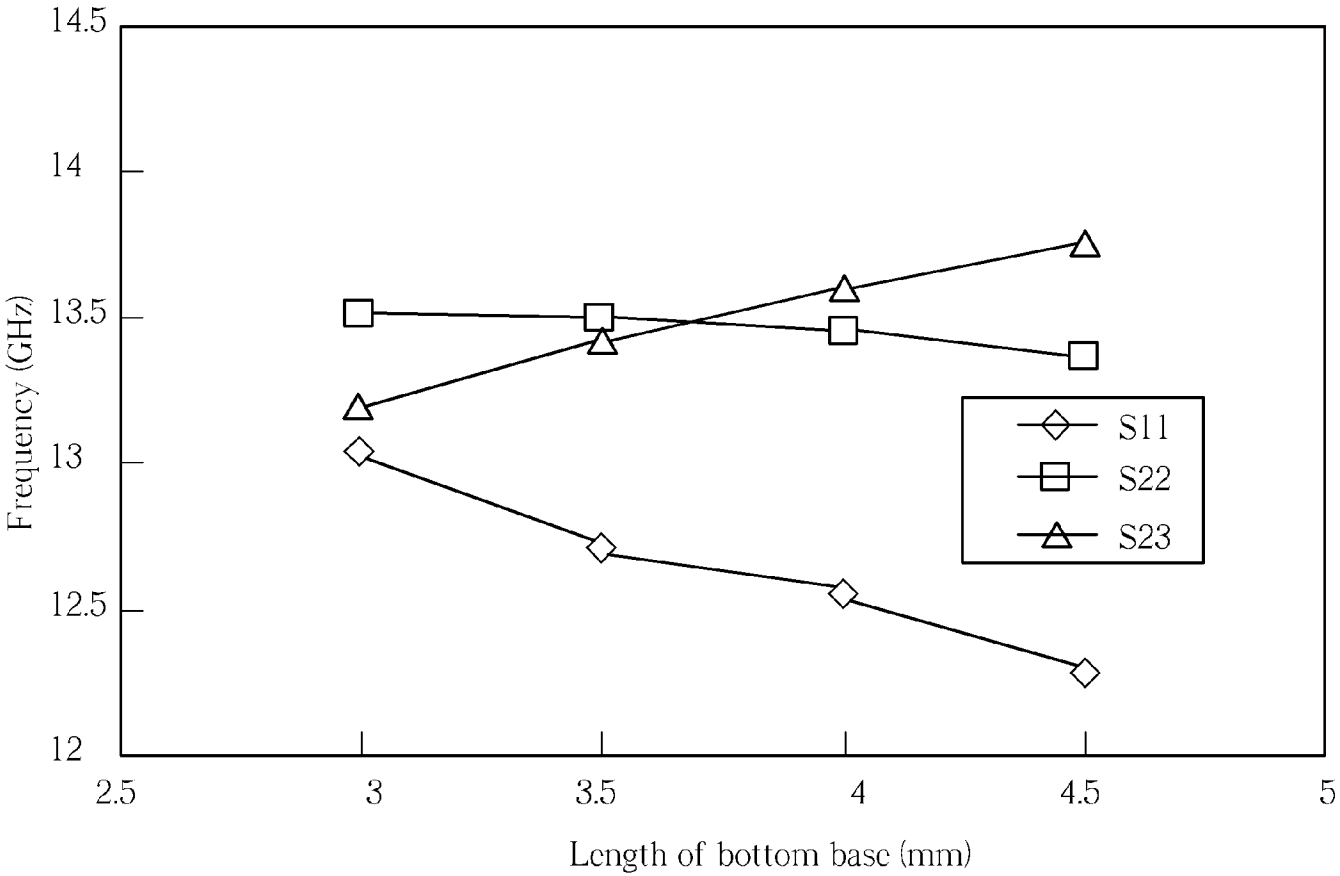
FIG. 9 is a relative diagram of the length of the top base of the slit shown in FIG. 7 to the resonance frequencies according to an embodiment of the invention.
Figure 10:
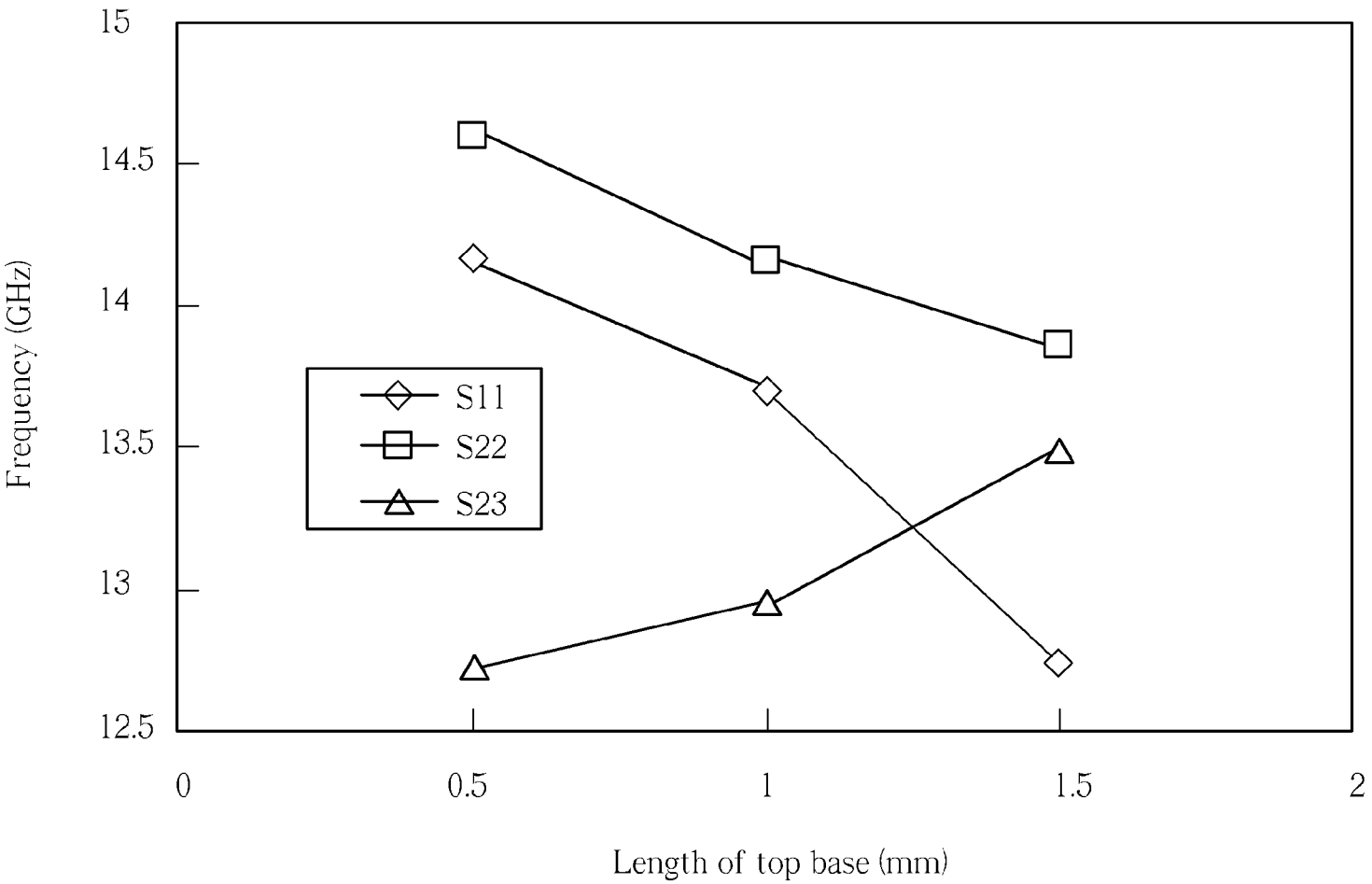
FIG. 10 is a relative diagram of the length of the bottom base of the slit shown in FIG. 7 to the resonance frequencies according to an embodiment of the invention.

In the embodiment, the slit 314 is a long narrow slot or cut formed in the ground layer 312, which can be any shape of slot structure. For example, as shown in FIGS. 3 to 5, the slit 314 is a long and narrow rectangular-shaped slit (with high aspect ratio). As shown in FIG. 7, the slit 314 is a trapezoidal-shaped slit, which the length of the top base (short base) plane of the slit 314 is S, and the length of the bottom base (long base) of the slit 314 is L. Preferably, the top base plane of the slit 314 is located within the second area A'. Please further refer to FIG. 8. FIG. 8 is a simulation result of the power divider 30 having a trapezoidal-shaped slit according to an embodiment of the invention, which is operated at 10.7 to 12.75 GHz band (Ku band), based on the power divider 30 shown in FIG. 7. As shown in FIG. 8, the bandwidth which the isolation parameter S23 is below −15 dB (isolation criterion) is about 4.5 GHz, and the reflection parameter S11 is approximately below −15 dB for all simulated band. In other words, the power divider 30 provides excellent isolation characteristics and less reflection loss. Please refer to FIGS. 9 and 10. FIG. 9 is a relative diagram of the length S of the top base of the slit 314 shown in FIG. 7 to the resonance frequencies according to an embodiment of the invention. FIG. 10 is a relative diagram of the length L of the bottom base of the slit 314 shown in FIG. 7 to the resonance frequencies according to an embodiment of the invention. The horizontal axis represents length of base, and the vertical axis represents resonance frequency. As can be seen in FIGS. 9 and 10, the shorter the length of the top base or the bottom base is, the isolation parameter S23 tends toward the lower frequency, but the reflection parameter S11 and S22 tend toward the higher frequency. As a result, the invention can adjust the resonance frequency of the power divider 30 by changing the length of the top base or the bottom base while using a trapezoidal-shaped slit.

Figure 1:
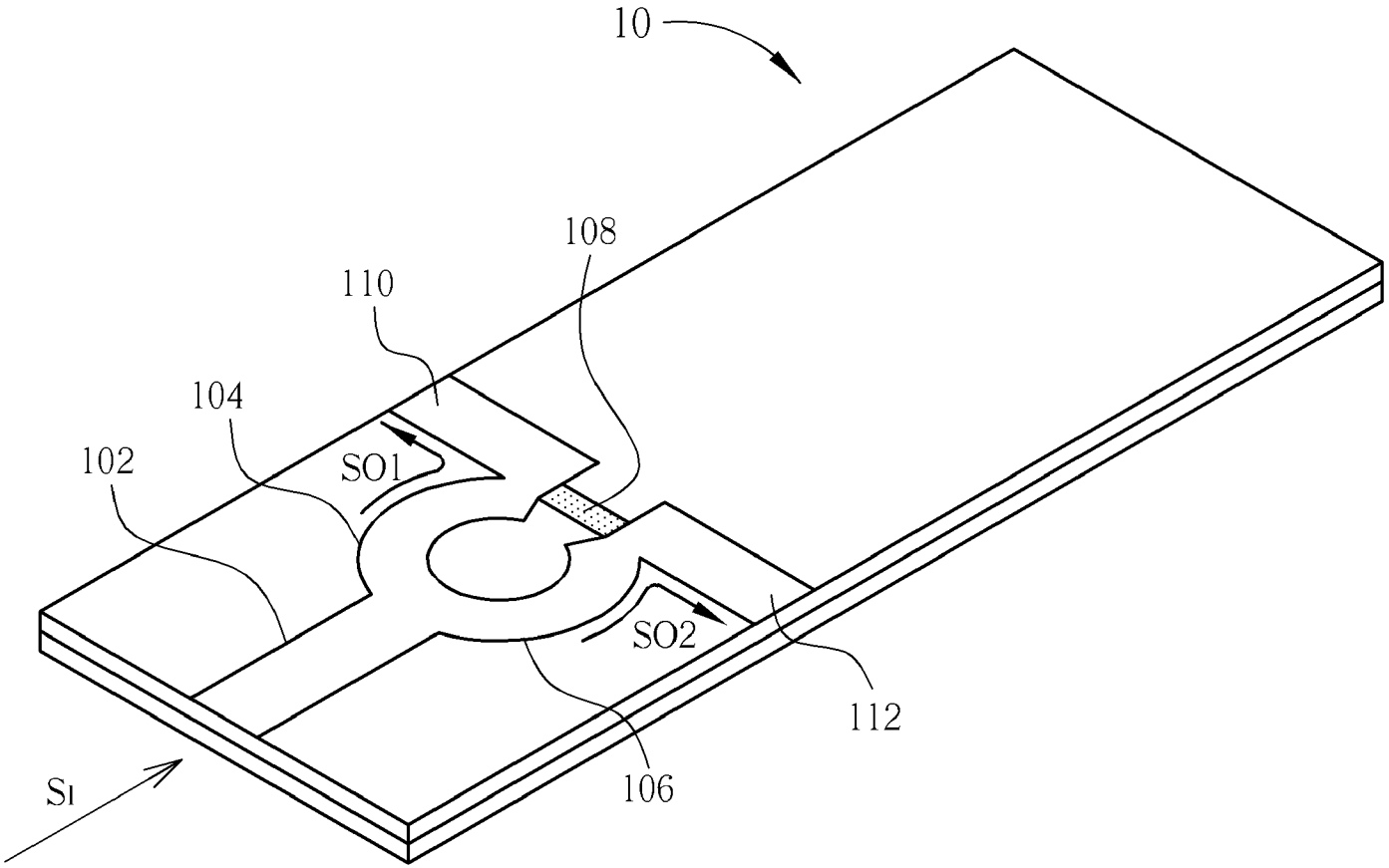
FIG. 1 PRIOR ART
FIG. 1 is a schematic diagram of a Wilkinson power divider in the prior art.
Figure 2:
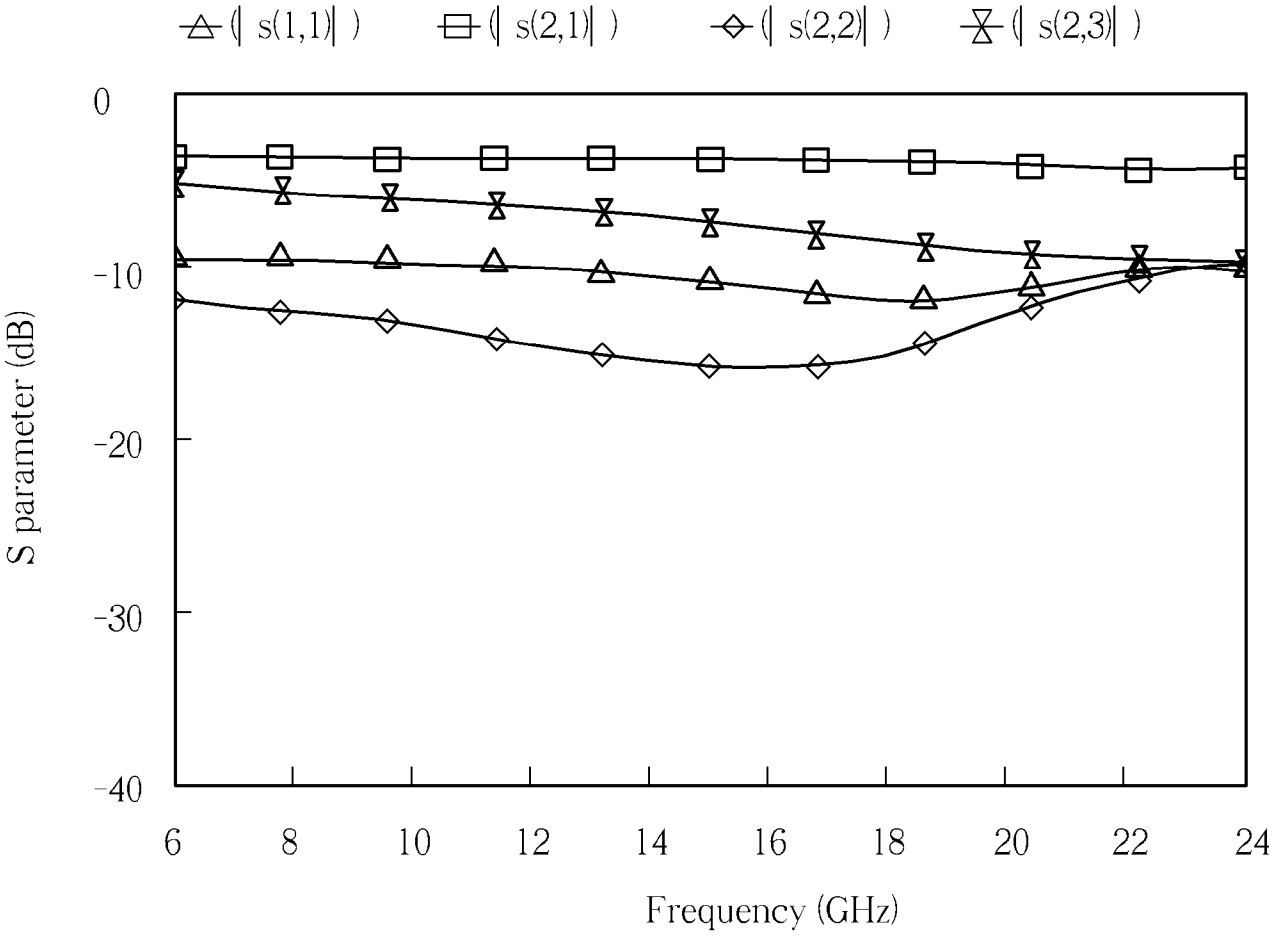
FIG. 2 PRIOR ART
FIG. 2 is a simulation result of the Wilkinson power divider using an ideal resistor at high frequency.
Figure 11:
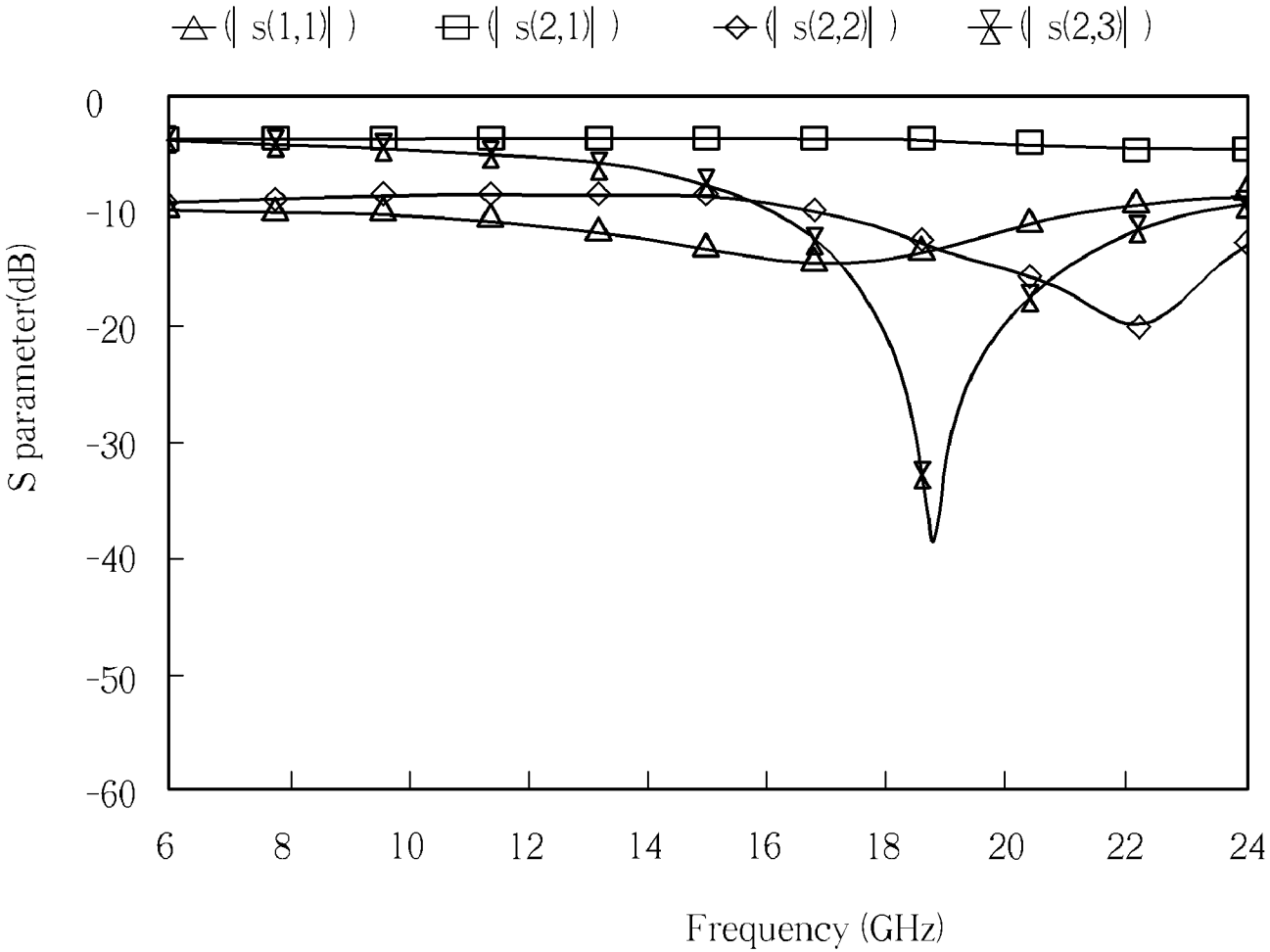
FIG. 11 is a simulation result of the power divider operating at Ka band according to an embodiment of the invention.

As mentioned previously, the conventional Wilkinson power divider needs to use a resistor between the split arms. Therefore, as the operating frequency is higher, the parasitic effect and electromagnetic coupling effect become more serious, so that when operating at high frequency band, the conventional Wilkinson power divider will not be able to provide sufficient isolation so as to cause bad electric characteristics. Comparatively, the power divider 30 does not require using resistor elements and is suitable to apply to high frequency band. For example, please refer to FIG. 11. FIG. 11 is a simulation result of the power divider 30 operating at Ka band according to an embodiment of the invention, which is operated at 18.2 to 20.2 GHz band, based on the power divider 30 shown in FIG. 7. As shown in FIG. 11, the isolation parameter S23 is below −18 dB among 18.2 to 20.2 GHz. Compared with the simulation result shown in FIG. 2, the invention enhances the isolation characteristic for 10 dB and upward. Besides, the reflection parameters S11 and S22 are below −10 dB, meaning there is less return loss. Therefore, the embodiment can improve drawbacks of the conventional Wilkinson power divider and be suitable for operating at high frequency band.

On the other hand, the power divider 30 of the invention can not only be implemented as the power divider for splitting an input signal into multiple output signals, but also be treated as a power combiner with opposite operation i.e. by reversing signal direction. Therefore, when the power divider 30 is functioned as a combiner, signals can be inputted via the first signal output unit 316 and the second signal output unit 318, and transmitted through the first split arm 304 and the second split arm 306. Finally, the signals transmitted through the first split arm 304 and the second split arm 306 can be combined at the signal input unit 308. In other words, the power divider 30 of the invention is capable of bidirectional operation for power dividing and combining.

Please note that, the power divider 30 is an exemplary embodiment of the invention, and those skilled in the art can make alternations and modifications accordingly. For example, the power divider 30 can be implemented at various signal bands, such as Ka band, Ku band, etc. The slit 314 can be formed in the ground layer 312 by an etching process or any other possible method. The substrate 302 can be any microwave substrates, such as RO4233 substrates. Generally speaking, either length or width of the first split arm 304 and the second split arm 306 can be changed in proportion to the divided power or other special requirements. For example, the length of the first split arm 304 can be designed to be equal to the length of the second split arm 306 for dividing signals with identical phase. The width of the first split arm 304 can also be designed to be unequal to the width of the second split arm 306 for dividing signals with different power. In addition, the length of the first split arm 304 and the second split arm 306 can be set to one quarter wavelength long or an odd-multiple of a quarter wavelength long for power dividing function.

In summary, compared with the conventional Wilkinson power divider, the power divider of the invention needs not use an extra resistor, reducing manufacturing cost, and has more excellent isolation characteristics. Moreover, the power divider of the invention is able to apply to high frequency band for satisfying power dividing requirement.

Those skilled in the art will readily observe that numerous modifications and alterations of the device and method may be made while retaining the teachings of the invention.

What is claimed is:

1. A high isolation power divider, comprising:

a substrate comprising a first plane and a second plane;

a first split arm deposited on the first plane of the substrate, wherein the first split arm comprises a first end and a second end;

a second split arm deposited on the first plane of the substrate, wherein the second split arm comprises a first end and a second end;

a signal input unit deposited on the first plane of the substrate, and coupled to the first end of the first split arm and the first end of the second split arm, for receiving an input signal and dividing the input signal to the first split arm and the second split arm;

a connection unit deposited on the first plane of the substrate, and coupled to the second end of the first split arm and the second end of the second split arm, wherein the connection unit, the first split arm, and the second split arm surround a first area;

a ground layer deposited on the second plane of the substrate for providing grounding, wherein the ground layer comprises a second area and the second area is an orthographic projection area of the first area onto the ground layer; and a slit formed in the ground layer;

wherein at least a part of the slit is formed within the second area.

2. The power divider of claim 1 further comprising:

a first signal output unit deposited on the first plane of the substrate, and coupled to the second end of the first split arm, for outputting the input signal from the first split arm; and a second signal output unit deposited on the first plane of the substrate, and coupled to the second end of the second split arm, for outputting the input signal from the second split arm.

3. The power divider of claim 1, wherein the slit is a rectangular-shaped slit.

4. The power divider of claim 3, wherein the slit is a long and narrow rectangular-shaped slit.

5. The power divider of claim 1, wherein the slit is a trapezoidal-shaped slit.

6. The power divider of claim 5, wherein a top base plane of the slit is located within the second area.

7. The power divider of claim 5, wherein length of the top base plane and the bottom base plane of the slit are both relative to resonance frequencies of the power divider.

8. The power divider of claim 1, wherein the slit is formed in the ground layer by an etching process.

9. The power divider of claim 1, wherein the first split arm, the second split arm, the signal input unit, and the connection unit are microstrip line structures.

10. The power divider of claim 1, wherein the substrate is an RO4233 substrate.

11. The power divider of claim 1, wherein the power divider operates at Ku-band.

12. The power divider of claim 1, wherein the power divider operates at Ka-band.

13. The power divider of claim 1, wherein length of the first split arm is equal to length of the second split arm.

* * * * *